United States Patent [19]

DeGroot

[11] 4,162,731

[45] Jul. 31, 1979

[54] LIGHTWEIGHT, QUICK ASSEMBLY FURNITURE

[76] Inventor: Theodore C. DeGroot, Box 17-2, Lebanon, N.J. 08833

[21] Appl. No.: 867,666

[22] Filed: Jan. 9, 1978

[51] Int. Cl.[2] ..... A47F 5/00

[52] U.S. Cl. ..... 211/126; 211/55; 211/135; 211/186

[58] Field of Search ..... 211/134, 135, 186, 126, 211/128, 153, 55; 108/106, 107, 111; 312/257 SM, 126

[56] References Cited

U.S. PATENT DOCUMENTS

| | | | |
|---|---|---|---|
| 657,661 | 9/1900 | Kinnear | 108/111 |
| 873,664 | 12/1907 | Estler | 211/126 |
| 2,108,122 | 2/1938 | Hall | 211/128 |
| 2,582,641 | 1/1952 | Mathews | 211/126 |
| 3,145,851 | 8/1964 | Magers | 211/186 |
| 3,191,776 | 6/1965 | Tokash | 211/55 |

FOREIGN PATENT DOCUMENTS

| | | | |
|---|---|---|---|
| 1050173 | 2/1959 | Fed. Rep. of Germany | 211/134 |
| 984962 | 7/1951 | France | 211/55 |
| 449325 | 6/1949 | Italy | 211/134 |
| 744147 | 2/1956 | United Kingdom | 211/135 |

*Primary Examiner*—Roy D. Frazier
*Assistant Examiner*—Robert W. Gibson, Jr.
*Attorney, Agent, or Firm*—David S. Woronoff

[57] ABSTRACT

A wide variety of lightweight, simple to assemble furniture items are formed from rigid load bearing (normally vertical) members, rigid cross rods (normally horizontal) fastened to the rigid load bearing members and flexible sheet material. The sheet material interconnects at least two rods to form a shelf, ledge, seat or other holder or support. The flexible members have spring-locking engagement with the rod members and a frictional engagement with the load bearing members. These three elements form a rigid unit when fastened together.

5 Claims, 12 Drawing Figures

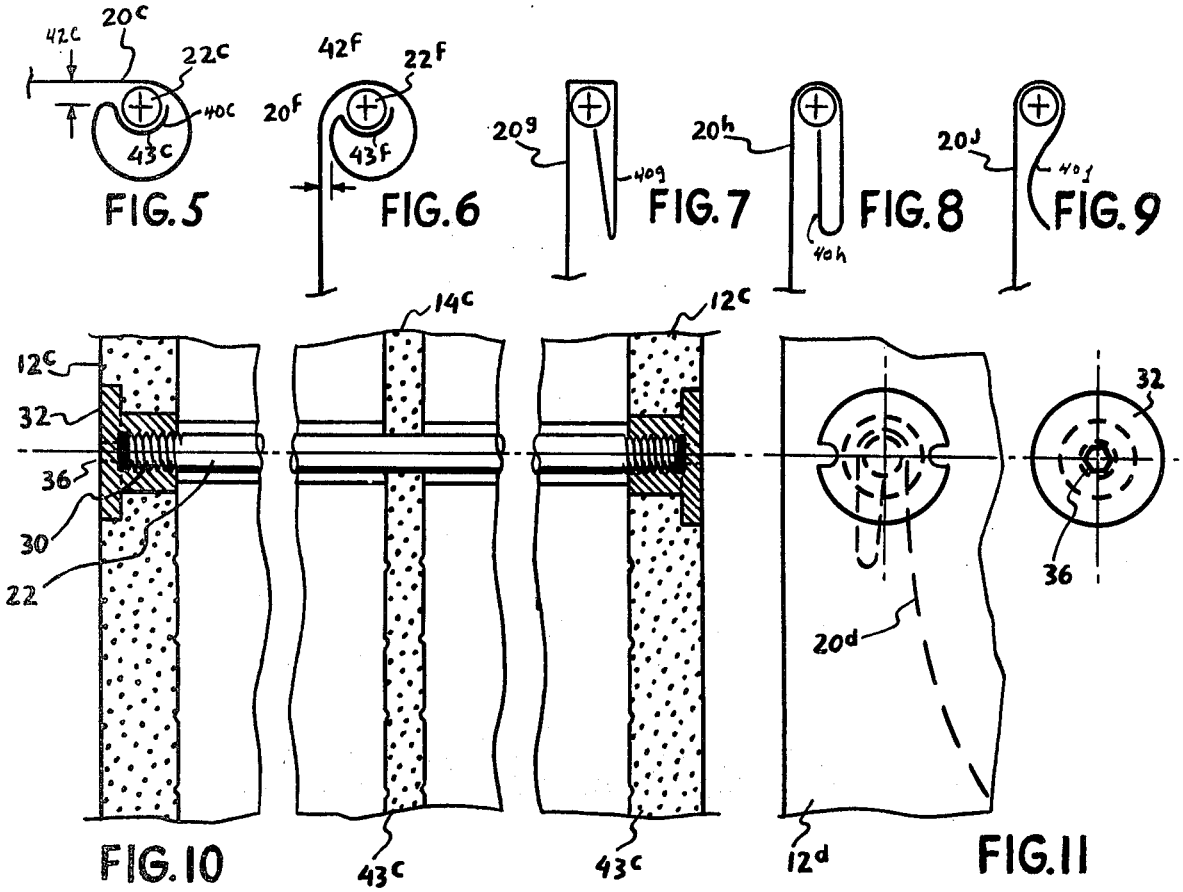
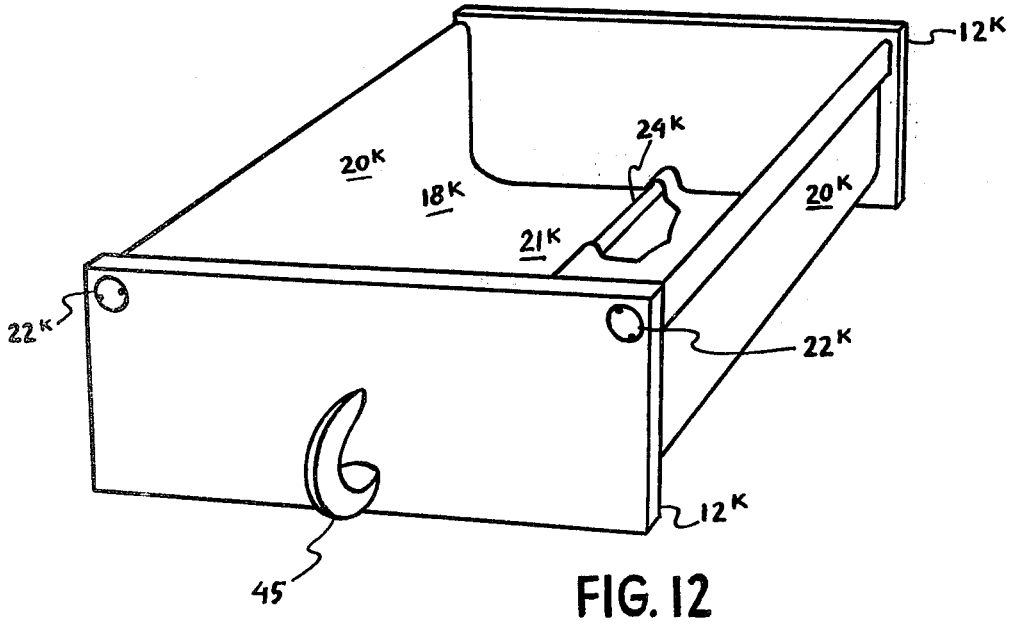
FIG. 12

LIGHTWEIGHT, QUICK ASSEMBLY FURNITURE

BACKGROUND OF THE INVENTION

A. Field of the Invention

The present invention relates to lightweight easy to assemble yet sturdy furniture and furnishings such as (but not limited to) shelves, cabinets, drawers, display cases, magazine racks, side tables, litter baskets, coffee tables, and many other similar items.

B. Prior Art

The commonly available light weight, easy to assemble furniture and furnishings require the use of screws, rivets, glue bolts and nuts or some combination of them to assemble the objects. Typically the load bearing members are oversized relative to the load to be supported, at least in part because they must accommodate the fasteners (screws, etc.).

SUMMARY OF THE INVENTION

The present invention discloses a novel group of simple components which may serve as the basic building blocks for assembly into a wide variety of useful furniture and furnishing objects such as, (but not limited to) shelves, bins, magazine racks, tables, desks, cabinets, planters, display cases, and many other items.

The basic structure employed utilizes a rigid load bearing member normally in the upright or vertical position when in use. A plurality of (normally) horizontal rods are fitted into the rigid load bearing members and retained into the assembled position. One or more flexible sheet members each engage at least two rod members in a detent formed in the flexible member. At least one of the ends of each flexible sheet member is formed into a spring and detent (or spring like detent) for engaging a rod or shaft. The flexible sheet members may have a toothed edge for increased frictional engagement to the side of the load bearing member. If the structure has more than two load bearing members, the inner member may be of lighter stock than the outer member. The vertical members may be formed of pressboard, masonite, lightweight plywood or particle board. The flexible members may be formed of light weight sheet metal cardboard, plastics and similar materials. The rods may be formed of any relatively rigid material. The flexible members which may be formed of sheet metal, plastic, cardboard and other similar materials can have a thickness of 0.010 inches or less per sheet.

BRIEF DESCRIPTION OF THE DRAWING

FIGS. 5, 6, 7, 8 and 9 show different embodiments of the flexible member elastic detent structure.

FIG. 10 shows a sectional view of the load bearing members to show their interconnection to the rod members.

FIG. 11 shows a side view of the edge of the flexible member which abuts a load bearing member and engages a rod member.

FIG. 12 shows another embodiment of the present invention in perspective assembled into a drawer.

DESCRIPTION OF THE INVENTION

Figure 1:
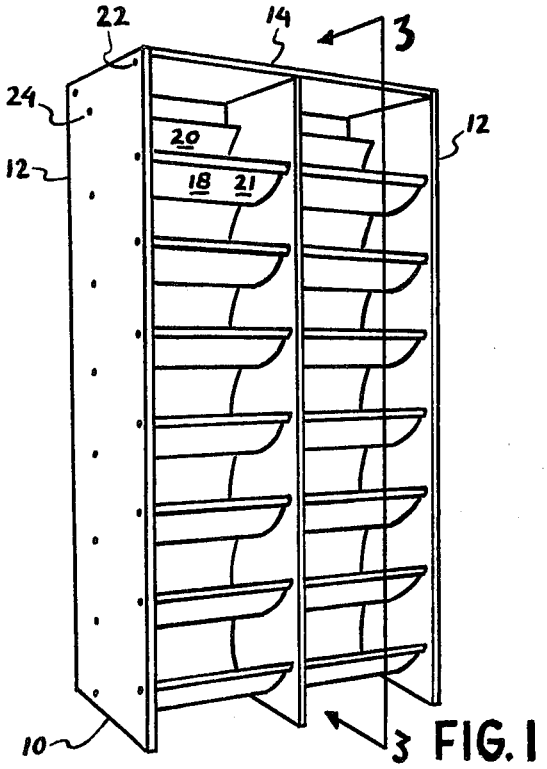
FIGS. 1 and 2 show perspective views of different structures which may be formed from different embodiments of the present invention.
Figure 2:
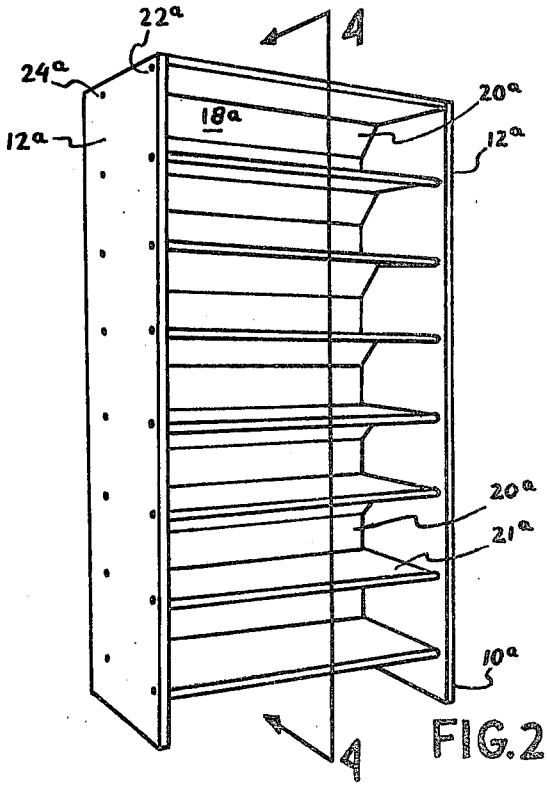

FIGS. 1 and 2 show in perspective two (among many) structures which may be assembled using the present inventive components. A multi-bin cabinet indicated generally by the numeral 10 is shown in FIG. 1 and a set of shelves is shown generally by the numeral 10*a* in FIG. 2.

Figure 3:
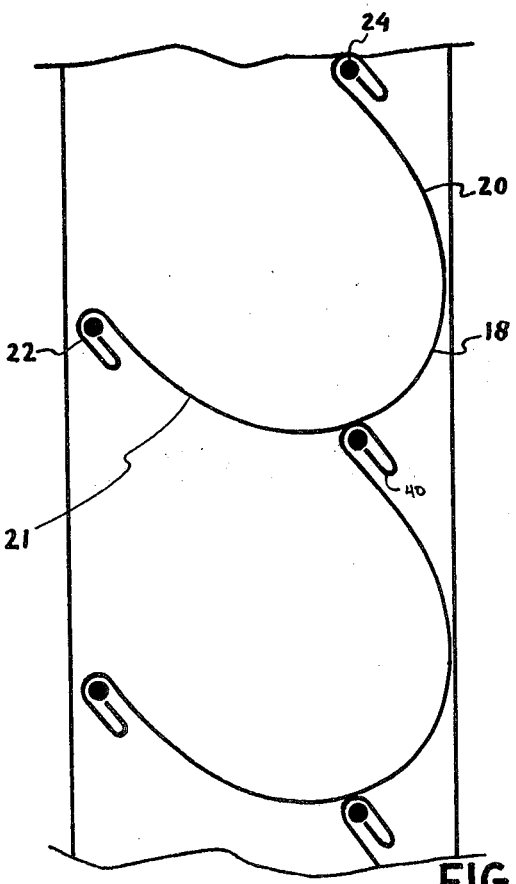
FIGS. 3 and 4 show sectional views of the structures shown in FIGS. 1 and 2 taken along the lines 3—3 and 4—4 in the FIGS. 1 and 2 respectively.
Figure 4:
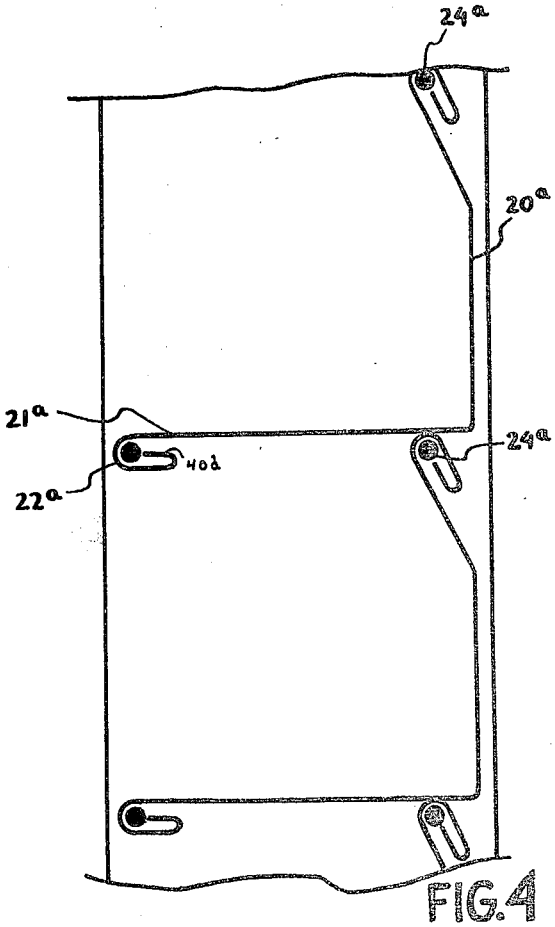

In each Figure like parts are illustrated by like numerals differing by a suffix—i.e., 12 and 12*a* each perform a like function. FIGS. 3 and 4 show sectional views of the FIGS. 1 and 2 taken along the lines 3—3 and 4—4 in FIGS. 1 and 2 respectively. FIG. 12 shows in perspective another embodiment of the present invention. Main load bearing planar members 12, 12*a*, 12, (FIGS. 1, 2, 3, 4, and 12) which are normally vertical and may be formed from any material preferably pressboard, masonite, luan plywood or similar light weight and low strength materials. Fixedly connected to the main load bearing members are cross-rods 22, 24, 22*a*, 24*a*, 22*k* and 24*k*. The rods 22, 24, are shown in FIG. 10 have threaded ends 30, etc. which mate with nuts 32 having keyways 36 for engagement by allen wrenches or the like. A lighter weight (thinner) load bearing column 14 is disposed intermediate the two heavier or stronger columns 12. The combination of rod and planar members from a supporting shell.

The article holding surfaces as shown in FIGS. 1 and 2 are shelves, 18, 18*a*, 18*b*. Each shelf has essentially a vertical and horizontal component 20*a*, 20*b*, and 21*a*, 21*b* respectively. The structure for interconnecting the bins or shelves to the rods is shown in FIGS. 3 through 9. Each flexible bin or shelf end (be it 20 or 21) has a curved end portion 40 which is shown formed into a variety of shapes or engaging surfaces (40 through 40*d*) having an open end (42 through 42*d*) smaller than the diameter of the rod 22 or 24 to which it will be interconnected. A detent or latch surface 43, 43*a*, etc. is formed in the cooperation between the curved shape (40 through 40*j*) the smaller opening (42 through 42*j*) and the resilient nature of the material which may be used to form the shelves 18 and especially the ends thereof. The shapes of the ends are shown as modified "c" or "e" shapes. The bins may be formed from steel, plastic, cardboard, plywood or other similar materials of about 0.010 inches thickness per sheet of selected material. The curvature or angled shape of the flexible members adds rigidity and strength to the entire structure. The flexible members may have teeth 50 formed on one or both edges for providing a second engaging mechanism for transferring load to a vertical support.

Each bin gets load bearing support from at least two rod members and as shown in FIGS. 3 and 4 from three rod members. If the rods 22 may be thought of as the rear rods i.e., those opposite the mouth of the bin 18, each bin is supported by two rods 22. One contacts the inner surface of the bins directly the other through another bin member.

Although the invention has been described with reference to particular embodiments of the invention, all the variations of the invention apparent to those skilled in the art are intended to be protected by the appended claims.

The FIG. 12 embodiment shows the present invention in the form of a drawer which has a handle 45 fitted into the end of rod 24*k*. This embodiment illustrates another example of the basic flexibility of the present inventive concept to be formed into a wide variety of forms.

What is claimed is:

1. An article of furniture comprising: a plurality of load bearing members formed from a light weight and low strength material; a plurality of extending members interconnecting said load bearing members for forming a shell therewith when interconnected; a shelf means formed from a light weight flexible material having a first engaging surface formed thereon for engaging said extending members; said engaging surface having a flexible detent member formed thereon for engaging said extending member in a positive locking action; and, said engaging surface is formed in an "e" shape where the open portion of the "e" is smaller than said extending member; said "e" is formed into a latch member which requires releasing to nondestructively remove the extending member from engagement with said "e" shape.

2. The article claimed in claim 1 wherein:

said flexible material has edges formed into a second engaging surfaces for engaging said load bearing members.

3. The article claimed in claim 1 wherein: said shelf means has edges formed into second engaging surfaces for engaging said load bearing members; said second engaging surfaces comprise a plurality of toothed members formed on the edge of the flexible material.

4. The article claimed in claim 1 wherein:

said engaging surfaces having flexible detent members thereon are formed on two ends of said flexible material for engaging said extending members on two ends of said flexible material.

5. The article claimed in claim 1 wherein: said article comprises at least four extending members arranged vertically in at least two rows; at least two vertically arranged in upper and lower shelf means each having engaging surfaces formed thereon for engaging one of said extending members in each row; said engaging surfaces having an outer surface; said shelf means having a central portion between said engaging surfaces; the engaging surface outer portion of the lower shelf means abuts the upper shelf means central portion for contributing to the support of said upper shelf means by taking to one of the extending members a portion of the load on the upper shelf means.

* * * * *